US006305059B1

(12) United States Patent
Mayer

(10) Patent No.: US 6,305,059 B1
(45) Date of Patent: Oct. 23, 2001

(54) METHOD AND APPARATUS FOR STUFFER BOX CRIMPING A YARN

(75) Inventor: Manfred Mayer, Remscheid (DE)

(73) Assignee: Barmag AG, Remscheid (DE)

( * ) Notice: Subject to any disclaimer, the term of this patent is extended or adjusted under 35 U.S.C. 154(b) by 0 days.

(21) Appl. No.: 09/496,099

(22) Filed: Feb. 1, 2000

(30) Foreign Application Priority Data

Feb. 6, 1999 (DE) ..... 199 04 973

(51) Int. Cl.[7] ..... D02G 1/12

(52) U.S. Cl. ..... 28/248; 28/250; 28/255; 28/263

(58) Field of Search ..... 28/248, 249, 250, 28/251, 263, 264, 265, 267, 268, 271, 269, 254, 255, 257, 256; 57/264, 93

(56) References Cited

U.S. PATENT DOCUMENTS

| | | | | |
|---|---|---|---|---|
| 3,961,042 | * | 6/1976 | Ferrier et al. | 28/72.14 |
| 3,977,058 | * | 8/1976 | Borenstein et al. | 28/1.7 |
| 4,118,843 | | 10/1978 | Schippers et al. . | |
| 4,337,557 | * | 7/1982 | McDonald | 28/250 |
| 4,369,555 | * | 1/1983 | Nikkel | 28/221 |
| 4,399,597 | * | 8/1983 | Rogers, Jr. | 28/250 |
| 5,088,168 | | 2/1992 | Berger et al. . | |
| 5,351,374 | * | 10/1994 | Nabulon et al. | 28/250 |
| 5,727,293 | * | 3/1998 | Weder | 28/249 |
| 5,802,832 | * | 9/1998 | Foster | 57/264 |

FOREIGN PATENT DOCUMENTS

| | | |
|---|---|---|
| 1 236 126 | 9/1967 | (DE) . |
| 23 24 827 B2 | 8/1981 | (DE) . |
| 42 24 454 C2 | 6/1996 | (DE) . |

* cited by examiner

*Primary Examiner*—Amy B. Vanatta
(74) *Attorney, Agent, or Firm*—Alston & Bird LLP

(57) ABSTRACT

A method and an apparatus for stuffer box crimping a spun multifilament yarn, wherein the yarn is packed in a crimping device to form a yarn plug. After cooling the yarn plug, it is unraveled into a yarn. In so doing, the position of the unraveling point is adjusted by varying the withdrawal speed of the yarn. At the same time when the withdrawal speed is varied, a signal is generated for controlling at least one of the parameters of the crimping device, which influences the formation of the yarn plug, so that it is possible to produce a uniformly crimped yarn.

16 Claims, 3 Drawing Sheets

METHOD AND APPARATUS FOR STUFFER BOX CRIMPING A YARN

BACKGROUND OF THE INVENTION

The present invention relates to a method of stuffer box crimping a multifilament yarn, as well as an apparatus for carrying out the method.

To produce a crimped yarn, it is known to compress a freshly spun yarn consisting of a plurality of filaments to a yarn plug by means of a crimping device. To this end, the crimping device is designed and constructed, for example, as a texturing nozzle. This texturing nozzle comprises a yarn channel, in which a hot medium, preferably air advances the yarn. The yarn channel terminates in a stuffer chamber. The yarn plug is formed inside the stuffer chamber. In this process, the yarn deposits in loops on the surface of the yarn plug and is compressed by the conveying medium, which is allowed to escape from the stuffer chamber through slots above the yarn plug. Subsequently, the yarn plug is removed from the stuffer chamber and cooled by means of a downstream cooling device. After cooling, the yarn plug is unraveled to the crimped yarn.

In this process, the crimp of the yarn is decisively influenced in its intensity and stability by the plug formation and by the thermal treatment of the yarn plug. Thus, besides the temperature and the pressure of the conveying medium, the dwelling time of the yarn plug during the thermal treatment also constitutes a parameter that has a decisive influence on the crimping result.

For example, it has been known for a long time to control the feed and/or the withdrawal speed of the yarn such that a uniform formation of the yarn plug is maintained during the process. An apparatus and a method of this kind are disclosed, for example, in DE 1 236 126. There, for purposes of monitoring the yarn plug, the position of the unraveling point at the end of the yarn plug is determined and adjusted to a predetermined level by changing the withdrawal speed of the yarn.

The known method is suitable only to a limited extent to produce a yarn with a uniform crimp, since it does not enable a direct intervention in the formation of the yarn plug. Thus, for example, fluctuations in the temperature or the pressure of the conveying medium may lead to considerable differences in the crimp of the yarn.

To be able to intervene in the thermal treatment of the yarn directly, DE 23 24 827 proposes a method and an apparatus, wherein the heat supply to the yarn plug is adjusted as a function of the position of the unraveling point of the yarn plug.

Furthermore, it is known from DE 42 24 454 and related U.S. Pat. No. 5,088,168 to adjust the heat supply to the yarn plug as a function of a yarn tension necessary to unravel the yarn plug.

The known methods, wherein the heat supply is adjusted to realize a uniform crimp in the yarn, are unsuitable in processes operating at high yarn speeds of more than 3,000 m/min. The intervention in the yarn plug formation is too sluggish to prevent the yarn plugs from shifting, which leads to an unsteady behavior of the process in the extreme case.

It is therefore an object of the invention to provide a method of stuffer box crimping a multifilament yarn of the initially described kind, as well as an apparatus for carrying out the method, wherein a yarn is produced with a uniform crimp in particular at high yarn speeds of more than 3,000 m/min.

SUMMARY OF THE INVENTION

The above and other objects and advantages of the invention are achieved by the provision of a method and apparatus wherein the yarn is fed into a crimping device to form a yarn plug, and then cooling the yarn plug within a cooling zone. The yarn is withdrawn from an unraveling point of the yarn plug adjacent the end of the cooling zone, and the position of the unraveling point is adjusted by changing the withdrawal speed. Upon a change of the withdrawal speed, a signal is generated for controlling at least one of the parameters of the crimping device so as to influence the formation of the yarn plug.

The invention distinguishes itself in particular by a stable process control with a controlled and regulated plug formation. In this process, the change in the withdrawal speed is used both for adjusting the length of the yarn plug and for controlling the formation of the yarn plug. The inventive combination between the position adjustment of the unraveling point of the yarn plug and the control of the yarn plug formation has the advantage that the fluctuations in the parameter adjustment of the crimping device are constantly compensated irrespective of the wear of the crimping device. The position of the yarn plug remains unaffected by such fluctuations and leads to a stable course of the process. A continuous control of the parameters of the crimping devices ensures a uniform quality of the crimp in the yarn. To this end, a signal is generated for controlling at least one parameter of the crimping device, which influences the formation of the yarn plug, when the withdrawal speed changes. In the case of a texturing nozzle, the parameters that are controlled are in particular the temperature and pressure of the conveying medium. Further parameters that may be made controllable are, for example, the speed of the entering yarn or the speed of the yarn plug leaving the crimping device.

An especially preferred further development of the method has the advantage that the effects of the control for forming the yarn plug are controllable. To this end, the change in the withdrawal speed is repeatedly determined at predetermined time intervals by a comparison between a desired value and an actual value of the withdrawal speed. The desired value of the withdrawal speed may correspond to a stored, optimal adjustment, to which corresponding parameter adjustments of the crimping devices are associated.

Should it be found in the comparison that the desired value of the withdrawal speed is equal to the actual value of the withdrawal speed, no signal will be generated for the control. In this instance, the adjusted parameters and withdrawal speeds will lead to an optimally crimped yarn. However, if a deviation is found between the desired value of the withdrawal speed and the actual value of the withdrawal speed, a signal will be generated accordingly for controlling at least one of the parameters of the crimping device, which influences the formation of the yarn plug.

To obtain a correction of the adjusted values as quickly as possible and, thus, small deviations from a predetermined crimp quality, the variant of the method as follows is especially advantageous. Specifically, it is generally known that a loose yarn plug occupies a greater length. To keep in this instance the yarn plug at a constant length, the adjustment will effect an increase in the withdrawal speed. If it is found in the comparison between the desired value and the actual value of the withdrawal speed that the actual speed is greater than the desired speed, the signal will cause a parameter change, which leads to an increase in the packing density of the yarn plug. This can occur, for example, in that the temperature of the conveying medium is increased. As a result of the greater packing density, the yarn plug becomes shorter. In the case that the desired value is greater than the actual value of the withdrawal speed, the signal will cause a parameter change, which leads to a reduction of the packing density of the yarn plug. Thus, the yarn plug would lengthen without an adjustment.

The especially preferred variant for carrying out the method of the present invention distinguishes itself in that direct use is made of the unraveling point and, thus, the controlled value for controlling the parameter of the crimping device. To this end, the withdrawal speed is repeatedly adjusted at predetermined time intervals to a predetermined desired value. At the same time, the position of the unraveling point of the yarn plug is determined. If a change occurs in the position of the unraveling point, a corresponding signal will be generated for controlling the parameter of the crimping device.

In this connection, corresponding parameter changes will be generated from the kind of position change of the yarn plug. In the case of a shortening of the yarn plug, the signal will effect a parameter change, which leads to a decrease in the packing density of the yarn plug. In the case of a lengthening of the yarn plug, the signal will effect a parameter change, which leads to an increase in the packing density of the yarn plug.

Since both the withdrawal speed and the parameters of the crimping device directly influence the crimp result of the yarn, it is possible to adjust same, according to a particularly advantageous variant of the method, only within predetermined limit values. If one of the limit values is exceeded, the process will be interrupted. In this instance, an unacceptable crimp quality would be produced.

The change in the withdrawal speed may directly occur by a takeup device, so that the yarn is wound to a package without greater tension fluctuations.

In a further variant of the method, the yarn is withdrawn by means of a feed system downstream of the cooling zone. In this process, the yarn is wound under a controlled tension.

The inventive combination between the control of the crimping device and the adjustment of the yarn plug length is realized in an apparatus of the present invention, in that a controller is provided for controlling at least one parameter of the crimping device, which influences the formation of the yarn plug. The controller connects, via a signaling line, to the adjusting device, so that it is possible to supply to the controller, for example, a controlled value, a command value, a correcting value, or a signal modified from the values.

The further development of the apparatus of the invention is especially advantageous for monitoring the effects of the control. In this embodiment, the adjustment of the position of the unraveling point or the length of the yarn plug is temporarily interrupted at a certain time. In so doing, a sensor continues to determine the position of the unraveling point. Thus, the sensor directly delivers a measured value, which may be used as a measure for the parameter change of the crimping device. With that, the further development enables the production of a crimped yarn, during which the crimp quality is iteratively maintained at a uniform, superior quality.

To be able to respond to parameter fluctuations of the crimping device as quickly as possible, the sensor signal is continuously supplied to the controller, so that superposed to the adjustment, it is possible to monitor the control at the same time.

BRIEF DESCRIPTION OF THE DRAWINGS

In the following, both the method and the apparatus of the present invention are described in greater detail with reference to the attached drawings, in which.

DETAILED DESCRIPTION OF THE PREFERRED EMBODIMENTS

Figure 1:
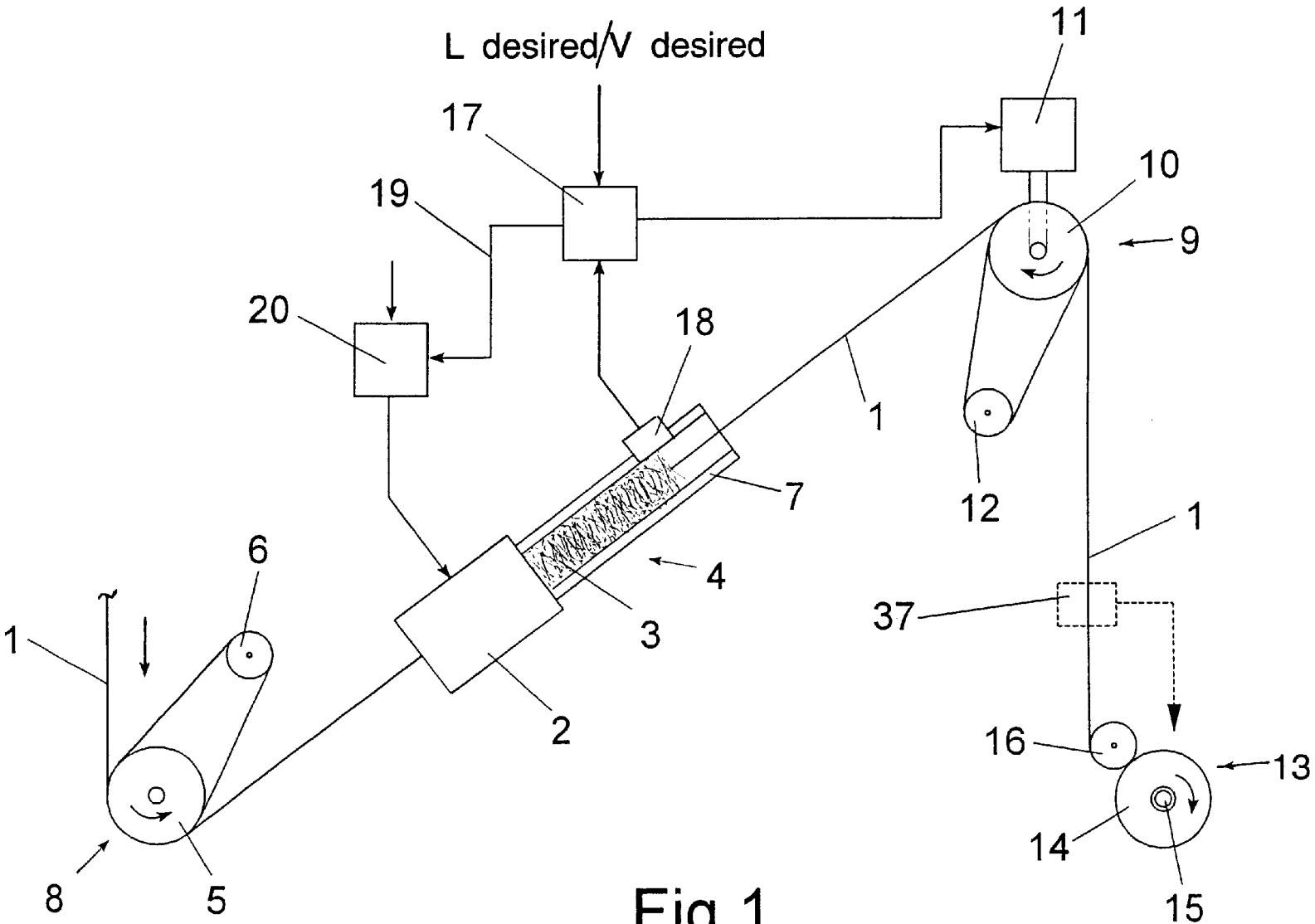
FIG. 1 is a schematic view of a first embodiment of an apparatus according to the invention for stuffer box crimping a multifilament yarn.
Figure 2:
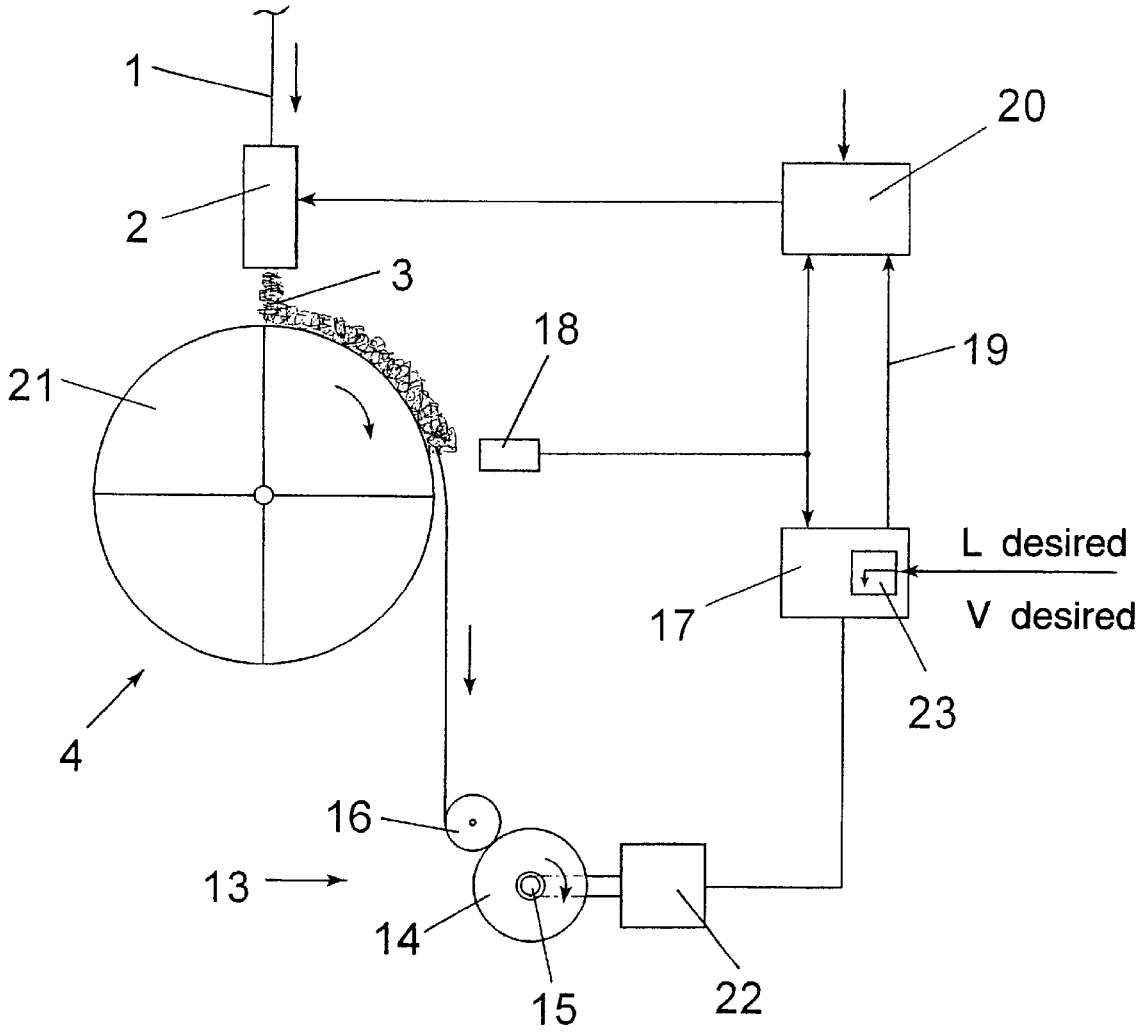
FIGS. 2 and 3 are each a further schematic view of the apparatus according to the invention.
Figure 3:
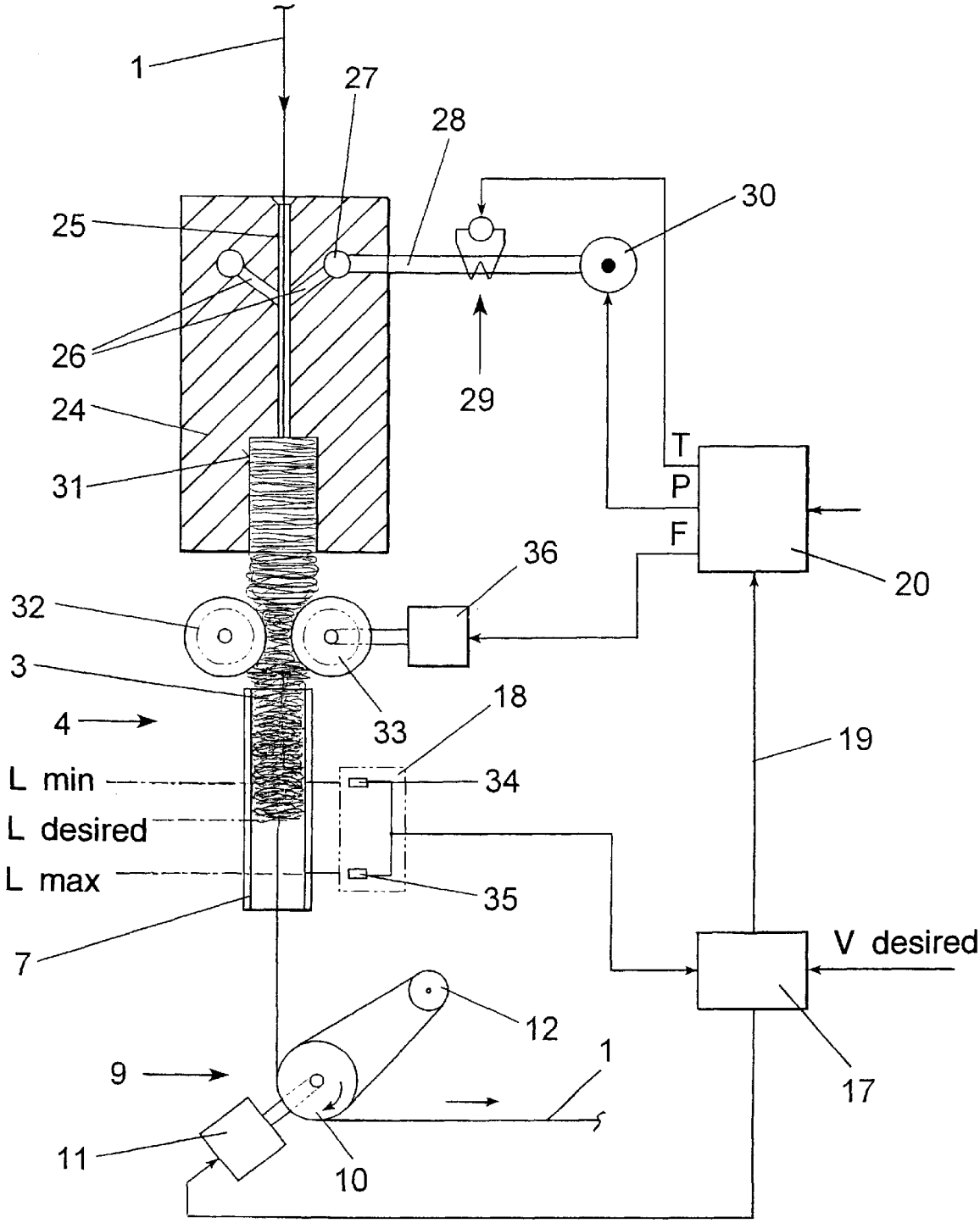

Each of the apparatus shown in FIGS. 1–3 is associated to a spinning line for producing a crimped multifilament yarn. An illustration of the spinning line has been omitted in the FIGS. 1–3.

In the spinning line, a yarn consisting of a plurality of filaments is extruded and spun from a thermoplastic melt. After cooling the filaments, the yarn is withdrawn and drawn, if need be, by one or more feed systems.

FIG. 1 illustrates a first embodiment of an apparatus according to the invention for carrying the method of the present invention. In this embodiment, a yarn 1 advances through a feed system 8 to a crimping device 2. In this process, the feed system 8 can withdraw the yarn 1 directly from a spinneret or from an upstream feed system. The feed system 8 consists of a driven godet 5 with a freely rotatable guide roll 6. The yarn 1 loops about godet 5 and guide roll 6 several times, before it advances from the godet 5 to the crimping device 2.

Within the crimping device 2, the yarn 1 forms a yarn plug, in that it is deposited in loops and compressed. The yarn plug 3 leaving the crimping device 2 then advances in a cooling device 4 along a cooling zone. The cooling zone is formed by a cooling tube 7. Preferably, the cooling tube comprises an air-permeable wall. In the end region of the cooling tube 7, a sensor 18 is arranged. The sensor 18, which is preferably designed and constructed as an electrooptical position detector, is used to determine the position of the unraveling point of yarn plug 3. In the unraveling point, the yarn plug 3 is disentangled to a yarn 1. A yarn withdrawal or feed system 9 withdraws the yarn 1 from yarn plug 3. The yarn withdrawal system 9 consists of a driven godet 10 and a freely rotatable guide roll 12, which are both looped by yarn several times. A godet drive 11 drives the godet 10 at a predetermined rotational speed. The yarn withdrawal system 9 is followed by a takeup device 13. In the takeup device 13, the yarn 1 is wound to a package 14. The package 14 is formed on a driven winding spindle 15. A contact pressure roll 16 lies against the circumference of package 14.

To obtain a uniform crimp of the yarn, the length of the yarn plug 3 is adjusted. To this end, the sensor 18 determines the position of the unraveling point of yarn plug 3. The sensor 18 connects to an adjusting device 17. The adjusting device 17 in turn connects to godet drive 11, so that the sensor 18 and adjusting device 17 form a closed control loop. Furthermore, the adjusting device 17 connects, via a signaling line 19, to a controller 20. For controlling the formation of the yarn plug, the controller 20 connects to crimping device 2.

In the apparatus shown in FIG. 1, the optimal adjustment data for the crimp, length of the yarn plug, as well as the withdrawal speed are determined and stored respectively in adjusting device 17 and controller 20 at the beginning of the process. These adjustment data are used to crimp yarn 1 and wind it to a package. Should it now happen that the yarn plug is too loose, so that a too weak crimp is present in the yarn, the length of the yarn plug is bound to become greater. This causes the position of the unraveling point of yarn plug 3 to shift in the direction toward the end of cooling tube 7. This change in position is detected by the sensor 18 and signaled to adjusting device 17. In the adjusting device 17, the deviation between a desired position $L_{desired}$ and an actual position $L_{actual}$ is converted into a correcting variable and supplied as a control value to the godet drive 11. In this process, it would be possible to convert, for example, the deviation of position δL into a speed deviation δV, so that $$V_{actual}=V_{desired}+\delta V$$

applies to the speed that is to be newly adjusted. The control value causes godet 10 to operate at a higher rotational speed, so that the withdrawal speed of yarn 1 increases. This causes the unraveling point of the yarn plug to shift in the direction of the desired position. An overflowing of the yarn plug from the cooling tube 7 is avoided. At the same time, the adjusting device 17 generates a signal that is supplied via signaling line 19 to controller 20. In response thereto, the controller 20 will change at least one parameter of the crimping device 2 to the extent that the volume of the yarn plug becomes smaller. The packing density of the yarn plug increases, so that a stronger crimp is realized in the yarn. Irrespective of the change in the packing density, the unraveling point of the yarn plug remains during the entire time in a desired position that is defined by the adjustment. However, the withdrawal speed that has been increased by the adjustment, is now slowly returned to its original value due to the increased packing density.

In the case that the length of the yarn plug shortens at the adjusted desired withdrawal speed, and thus generates too much crimp in the yarn due to the high packing density, the adjusting device 17 will effect a decrease of the withdrawal speed. At the same time, the controller will cause a parameter change of the crimping device 2, which leads to a lower packing density of the yarn plug. At high yarn speeds of more than 3,000 m/min., the adjustment of the withdrawal speed prevents the crimping device from running idle. At the same time, the crimping device effects an adaptation of the crimp.

To wind the yarn uniformly to a package in the embodiment of the apparatus according to the invention as shown in FIG. 1, it is preferred to adjust the takeup device 13 as a function of the yarn tension. To this end, a yarn tension sensor 37 is arranged in the yarn path upstream of the takeup device 13. In FIG. 1, the yarn tension sensor 37 is shown in phantom lines. A measuring signal of the yarn tension sensor 37 is supplied to the takeup device 13. Within the takeup device 37, the drive of winding spindle 15 is then adjusted such that the yarn tension remains substantially constant. The yarn tension-controlled takeup of the yarn makes it possible to compensate with advantage the rotational speed variations of the feed system 9 for adjusting the length of the yarn plug, so that the yarn 1 is wound to the package 14 without being influenced.

In a further embodiment of the apparatus according to the invention as shown in FIG. 2, the adjusting device 17 comprises a timer 23 to minimize the control expenditure. The timer 23 supplies the adjusting device 17 with a time sequence, which temporarily interrupts the adjustment at certain times to be able Lo perform a regulated control of the plug formation during this time. In the embodiment shown in FIG. 2, the yarn 1 advances through the crimping device 2 to a yarn plug 3. The yarn plug 3 advances to a cooling device 4, which is designed and constructed as a rotating cooling drum 21. In so doing, the plug 3 is deposited on the circumference of the cooling drum 21 and advanced over a portion thereof. The cooling drum 21 comprises an air-permeable wall. In the cooling drum 21, a vacuum is generated, so that ambient air is directed through the yarn plug 3 lying against the porous circumference. In its unraveling point, the crimped yarn 1 is withdrawn from cooling device 4 by takeup device 13 and wound to a package 14. To this end, the winding spindle 15 is driven by a spindle drive 22. The spindle drive 22 is controlled by adjusting device 17. The adjusting device 17 connects to a sensor 18. The sensor 18 is arranged in the region of the unraveling point of yarn plug 3 in the vicinity of the cooling drum surface. The crimping device 2 is controlled by controller 20. The controller 20 connects to adjusting device 17 and, via a separate line, to sensor 18.

The mode of operation of the apparatus shown in FIG. 2 is essentially the same as the mode of operation of the previously described apparatus of FIG. 1. To this extent, the description of the embodiment of FIG. 1 is herewith incorporated by reference.

In the apparatus shown in FIG. 2, the adjusting device 17 comprises a timer 23. At a time that recurs as a result of a predetermined time sequence, the timer 23 causes the spindle drive 22 to be adjusted to a desired value $V_{desired}$ of the withdrawal speed. At the same time, the adjusting device 17 signals this state to the controller 20 via the signaling line 19. Incoming signals from the sensor 18 are directly evaluated in controller 20. If sensor 18 signals a lengthening of the yarn plug 3, a parameter change will occur in the crimping device 2, which leads to an increase in the packaging density. If, however, a shortening of the yarn plug 3 is signaled, the controller will change at least one parameter of the crimping device 2 such that a loose yarn plug 3 is produced. Once the interruption time of the adjustment has elapsed, the position adjustment of yarn plug 3 resumes by varying the withdrawal speed. During this time, the adjusted parameters of the crimping device remain unchanged. Thus, for the time being the parameter change can become effective on the plug formation. Only after a steady state has set in with the changed parameters of the crimping device, is the adjustment again interrupted. The process of controlling the parameters of the crimping device 2 repeats itself. This approach realizes a regulated control of the crimping device 2. With that, it is possible to compensate all disturbing influences of the plug formation within a very short time, so that a substantially uniform crimp quality of the yarn is obtained.

FIG. 3 is a schematic view of a further embodiment of an apparatus according to the invention. In this embodiment, the crimping device is designed and constructed as a texturing nozzle 24 with a pair of rolls 32 and 33 for forming the yarn plug 3. The texturing nozzle comprises a central yarn channel 25. The yarn channel 25 essentially consists of two sections that are separated from each other by a narrowest cross section (not shown). In the first section, shortly upstream of the narrowest cross section, a plurality of nozzle bores 26 terminate in yarn channel 25. The nozzle bores 26 connect to an annular chamber 27. The annular chamber 27 connects, via a supply line 28, to a source of pressure 30 arranged outside of the texturing nozzle 24. In the section of the supply line 28 between the texturing nozzle 24 and the source of pressure 30, a heater 29 is provided for heating the pressure medium.

In the second section downstream of the narrowest cross section, the yarn channel 25 widens with a very small opening angle. An expansion chamber 31 directly adjoins the end of the yarn channel 25. Downstream of expansion chamber 31, a pair of rolls is arranged. The pair consist of rolls 32 and 33. A roll drive 36 drives the paired rolls 32 and 33.

Downstream of the paired rolls, a cooling device 4 extends. The cooling device 4 consists of a cooling tube 7. In the interior thereof, for purposes of cooling, the yarn plug 3 advances to an unraveling point. In the unraveling point, the yarn plug 3 is disentangled to the crimped yarn 1. A yarn withdrawal system 9 downstream of the cooling device 4 withdraws the yarn 1. The feed system consists of a godet 10 and a guide roll 12, which are looped by the yarn several times. A godet drive 11 drives the godet 10.

At the end of the cooling tube 7, two sensors 34 and 35 extend in spaced relationship in the direction of the advancing yarn. These sensors form the position sensor 18 and detect the unraveling point of the yarn plug 3. In so doing, the sensor 34 generates a signal, when the yarn plug falls short of a minimum length $L_{min}$. The sensor 35 generates a signal, as soon as the yarn plug 3 exceeds a maximum length $L_{max}$. As long as the yarn plug is within the acceptable range, the sensors 34 and 35 generate no signal. The sensors 34 and 35 connect to the adjusting device 17. The adjusting device 17 connects to the drive 11 of feed system 9, as has been described with reference to FIG. 1.

Furthermore, the adjusting device 17 connects, via signaling line 19, to the controller 20. The controller 20 serves to activate the heating device 29, source of pressure 30, and roll drive 36. In so doing, the controller can control one or all parameters, such as temperature T of the pressure medium, pressure P of the pressure medium, or conveying speed F of the paired rolls.

The mode of operation of the apparatus shown in FIG. 3 is identical with that of the embodiment illustrated in FIG. 1. Thus, the foregoing description of the operation is herewith incorporated by reference.

The embodiments of the apparatus according to the invention as illustrated in FIGS. 1–3, represent several possibilities of carrying out the method of the present invention. Basically, the method may also be carried out in combination of individual apparatus parts of the illustrated embodiments.

Likewise, the illustrated cooling devices are by way of example and may be replaced with other apparatus parts. For example, the cooling tube may be formed by a plurality of bars arranged in annular shape to one another. It would also be possible to replace the cooling drum with a flat cooling screen. To assist the cooling effect, it is also possible to connect blowers to the cooling devices for generating a cooling air stream.

What is claimed is:

1. A method of stuffer box crimping an advancing multifilament yarn comprising the steps of feeding the yarn into a crimping device to form a yarn plug and then cooling the yarn plug within a cooling zone, withdrawing the yarn from an unraveling point of the yarn plug adjacent the end of the cooling zone, with the position of the unraveling point being adjusted by changing the withdrawal speed of the yarn, and upon a change of the withdrawal speed, generating a signal for controlling at least one of the parameters of the crimping device so as to influence the formation of the yarn plug.

2. The method according to claim 1 wherein the change in the withdrawal speed is repeatedly determined at predetermined intervals by a comparison between a desired value ($V_{desired}$) and an actual value ($V_{actual}$) of the withdrawal speed.

3. The method according to claim 2 wherein the signal is generated when $V_{desired}>V_{actual}$ and when $V_{desired}<V_{actual}$, and no signal is generated when $V_{desired}=V_{actual}$.

4. The method according to claim 3, wherein when $V_{desired}>V_{actual}$, the generated signal will effect a parameter change which leads to a decrease in the packing density of the yarn plug, and wherein when $V_{desired}<V_{actual}$, the generated signal will effect a parameter change which leads to an increase in the packing density of the yarn plug.

5. The method according to claim 1, wherein the withdrawal speed is repeatedly adjusted at predetermined intervals to a predetermined desired value ($V_{desired}$), and wherein at the same time a change in the unraveling point of the yarn plug is detected, a corresponding signal is generated for controlling said at least one parameter of the crimping device.

6. The method according to claim 5, wherein in the case of a shortening of the yarn plug, the signal will effect a parameter change which leads to a decrease in the packing density of the yarn plug, and wherein in the case of a lengthening of the yarn plug, the signal will effect a parameter change which leads to an increase in the packing density of the yarn plug.

7. The method according to claim 1 wherein the one parameter of the crimping device is formed by an adjustable heating temperature and/or an adjustable conveying pressure.

8. The method according to claim 1 wherein the withdrawal speed and/or the parameter of the crimping device are adjustable within predetermined limit values, and that upon exceeding one of the limit values of the withdrawal speed or upon exceeding a limit value of the parameter, the formation of the yarn plug is interrupted.

9. The method according to claim 1 wherein the withdrawal speed is adjusted by the takeup device that winds the yarn to a package.

10. The method according to claim 1 wherein the withdrawal speed is effected by a feed system downstream of the cooling zone, and the yarn is wound to a package under a substantially constant yarn tension.

11. An apparatus for crimping an advancing multifilament yarn comprising a crimping device for receiving the advancing yarn which is fed thereinto by a yarn feeding device, and which forms the yarn into a yarn plug, a cooling device downstream of the crimping device for receiving the yarn plug, a yarn withdrawal device having a drive for withdrawing the yarn adjacent the end of the cooling device from an unraveling point of the yarn plug, an adjusting device for adjusting the position of the unraveling point of the yarn plug, the adjusting device being connected to the drive of the yarn withdrawal device and a sensor which senses the position of the unraveling point of the yarn plug, and a controller connected to the adjusting device for controlling at least one parameter of the crimping device which influences the formation of the yarn plug.

12. The apparatus according to claim 11, wherein the crimping device is designed and constructed as a texturing nozzle with an expansion chamber for forming the yarn plug, and wherein the temperature and/or the conveying pressure of a conveying medium is variable as a parameter by the controller.

13. The apparatus according to claim 12, wherein the adjusting device comprises a timer which interrupts the position adjustment of the unraveling point of yarn plug at an interval that recurs in a time sequence.

14. The apparatus according to claim 11 wherein the controller is connected to the sensor.

15. The apparatus according to claim 11 wherein the yarn withdrawal device includes a takeup device that winds the yarn into a package, wherein the adjusting device connects to a drive of the takeup device.

16. The apparatus according to claim 11 wherein the yarn withdrawal device includes a driven godet which is followed by takeup device which winds the yarn under a substantially constant yarn tension into a package.

* * * * *